United States Patent [19]

Tatematsu

[11] 4,186,858

[45] Feb. 5, 1980

[54] FOLDABLE HANGER

[76] Inventor: Shunji Tatematsu, 11-2, Shinnyo-cho, Jodo-ji, Sakyo-ku, Kyoto-shi, Kyotofu, Japan

[21] Appl. No.: 973,170

[22] Filed: Dec. 26, 1978

[30] Foreign Application Priority Data

Dec. 29, 1977 [JP] Japan ..... 52-178325[U]

[51] Int. Cl.[2] ..... A47J 51/098

[52] U.S. Cl. ..... 223/94

[58] Field of Search ..... 223/85, 87, 92, 94; 211/118

[56] References Cited

U.S. PATENT DOCUMENTS

| | | | |
|---|---|---|---|
| 1,468,200 | 9/1923 | Goldsmith | 223/92 |
| 1,758,932 | 5/1930 | Carter | 223/92 |
| 3,246,812 | 4/1966 | Walker et al. | 223/87 |
| 3,370,765 | 2/1968 | Jossem | 223/87 |
| 3,414,175 | 12/1968 | Brosk | 223/85 |
| 3,841,478 | 10/1974 | Wells et al. | 223/87 X |

*Primary Examiner*—George H. Krizmanich

*Attorney, Agent, or Firm*—Wenderoth, Lind & Ponack

[57] ABSTRACT

A foldable hanger for hanging a garment such as a coat or a suit in a folded manner along the center line of the back of the garment, which comprises a substantially elongated connecting member bendable or foldable about a portion substantially intermediate of the width of the connecting member, a pair of hands each being supported by the connecting member, and a pair of shoulders for hanging the garment each being supported by the connecting member at a position spaced from the hand.

6 Claims, 9 Drawing Figures

FOLDABLE HANGER

The present invention relates to a hanger for hanging a garment such as a coat or a suit and, more particularly, to a foldable hanger capable of supporting or hanging the garment in a folded state along a centre line on the back of the garment.

Conventionally, a foldable hanger having one hook engageable to a hanging bar or a hook provided on a supporter such as a wall and a pair of shoulders pivoted together by a hinge to enable the shoulders to be foldable about the hinge is known.

Such a foldable hanger is intended to design only for the purpose of transporting upon folding it into a compact and portable size when it is not used for hanging a garment.

Accordingly, it is difficult or impossible to use the conventional hanger for hanging a garment in a folded state.

One object of the present invention is to provide a foldable hanger capable of supporting or hanging a garment in a folded state along a centre line of the back of it.

Another object of the present invention is to provide a foldable hanger useful in handling with a suit or coat during a trip or journey.

A further object of the present invention is to provide a foldable hanger capable of hanging a garment compactly.

A still further object of the present invention is to provide a hanger capable of being used not only in a folded state but also in a spread state.

Another further object of the present invention is to provide a foldable hanger which can be manufactured easily with synthetic resin and at low cost.

A foldable hanger according to the present invention comprises a substantially elongated connecting member bendable or foldable about a portion substantially intermediate of the width of the connecting member, a pair of hands with hooks being supported by the connecting member and a pair of shoulders for hanging down the garment being supported by the connecting member at a position spaced downwardly from the hands.

The connecting member of the foldable hanger according to the present invention includes a pair of vertical columns and at least one flexible connecting band provided between said columns.

This connecting member supports the hand and the shoulders for hanging the garment thereon.

In the above construction of the foldable hanger according to the present invention, one of the essential features resides in that it is capable to hang downwardly the garment in a folded state along the centre line of the back thereof on the shoulders of the hanger.

It is essential in the foldable hanger of the present invention that the hands extend outwardly from the connecting member by an appropriate distance so that, when the hanger is folded, the hooks of the hands can be positioned on a vertical line passing through the centre of gravity of the garment in the folded state. In view of this, it is possible to hang down the garment in the folded state without any moment being generated around the hook.

Furthermore, the foldable hanger according to the present invention is easily manufactured with synthetic resin into one unitary body using any known injection molding method.

These and other objects and features of the present invention will become apparent from the following description taken in conjunction with the preferred embodiments thereof with reference to the accompanying drawings in which.

Before the description of the present invention proceeds, it is to be noted that like parts are designated by like reference numerals throughout the accompanying drawings.

Figure 1:
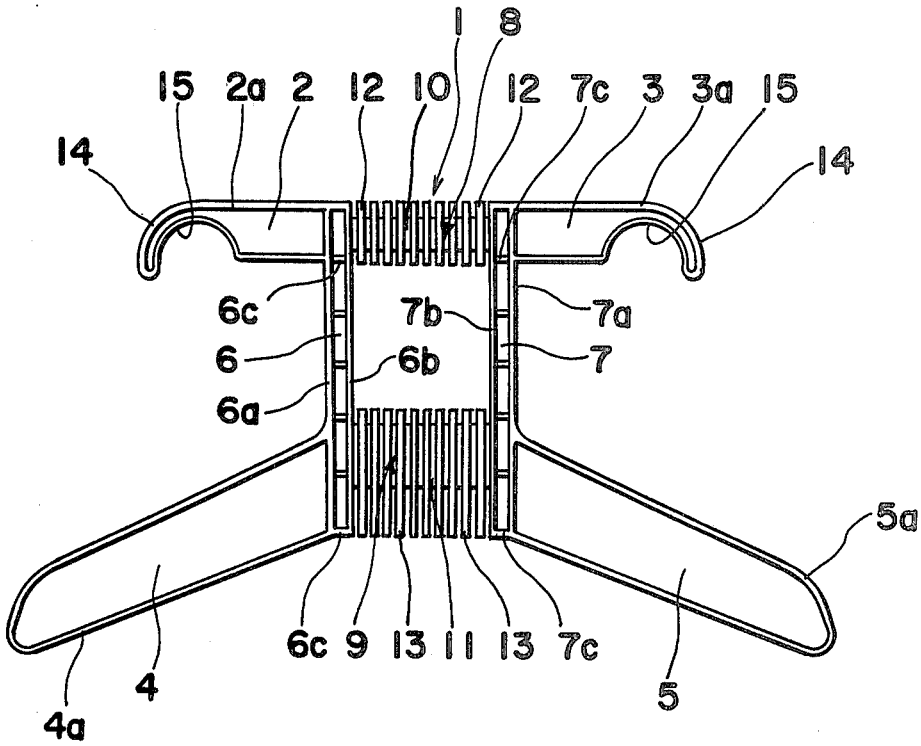
FIG. 1 is a front view showing a foldable hanger in a spread state according to one embodiment of the present invention.
Figure 2:
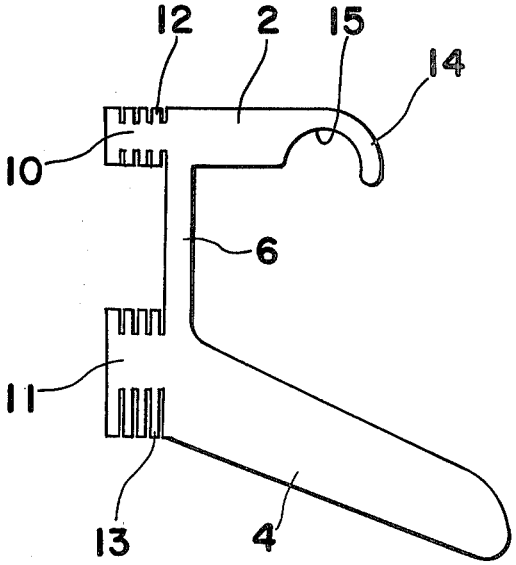
FIG. 2 is a side elevational view of the foldable hanger of FIG. 1 in a folded state.

Referring to FIG. 1, a foldable hanger according to one embodiment of the present invention is of one-piece construction made of a synthetic resin.

The foldable hanger comprises a foldable connecting portion 1, a pair of hands 2 and 3 and a pair of shoulders 4 and 5.

The foldable connecting portion is constituted by a pair of vertical stems 6 and 7 which are spaced an appropriate distance from each other and extend in parallel relation to each other, and an upper and a lower bridge portions 8 and 9 bridging between the vertical stems 6 and 7 at an upper and a lower end portions of said stems 6 and 7. Each vertical stem 6 or 7 is reinforced by a pair of vertical ribs **6*a* and 6*b* or 7*a* and 7*b*, extending in parallel to each other along the opposed sides of the vertical stem 6 or 7, and a plurality of transverse ribs generally designated by 6*c* or 7*c* and formed between the pair of the vertical ribs 6*a* and 6*b* or 7*a* and 7*b***.

Said upper and lower bridge portions 8 and 9 are respectively constituted by resiliently foldable bands 10 and 11 of relatively small width and small thickness bridging between the vertical stems 6 and 7, and a number of vertical bones 12 and 13 having a length approximately twice of the width of said bands 10 and 11, the vertical bones being respectively formed integrally with the associated bands 10 and 11 at a front surface thereof and arranged to space from each other a distance slightly smaller than the width of each vertical bone.

Figure 3:
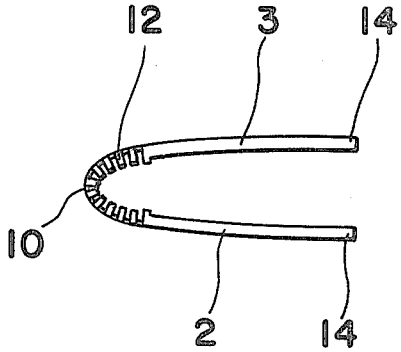
FIG. 3 is a top plan view of the foldable hanger of FIG. 1 in the folded state.

These vertical bones 12 and 13 impart a rigidity to the associated bands 10 and 11 and abuts each other at the time of folding the hanger with the bands 10 and 11 being bent in a smooth curvature as shown in FIG. 3, thereby to prevent from folding the bands 10 and 11 in a sharp angle which may cause a large sharing force in each of the bands.

The foldable hanger further comprises hands 2 and 3 extending outwardly from the upper ends of the stems 6 and 7 in a direction substantially perpendicular thereto.

Each hand 2 or 3 has a finger 14 curved downwardly so as to form a hook 15 at its free end for enabling the hanger to be engaged on or suspended from a hanging bar or a hanging hook provided at, for example, a wall (not shown). Each of the hands 2 and 3 is reinforced by a rib 2*a* or 3*a* formed along its periphery.

Extending outwardly from lower ends of the stems 6 and 7 in the opposed directions and downwardly inclined are shoulders 4 and 5 for the support of the garment thereon.

Respective base portions of the shoulders 4 and 5 are connected integrally to the stems 6 and 7. Each shoulder 4 or 5 is reinforced by a rib 4*a* or 5*a* formed along its periphery.

Figure 4:
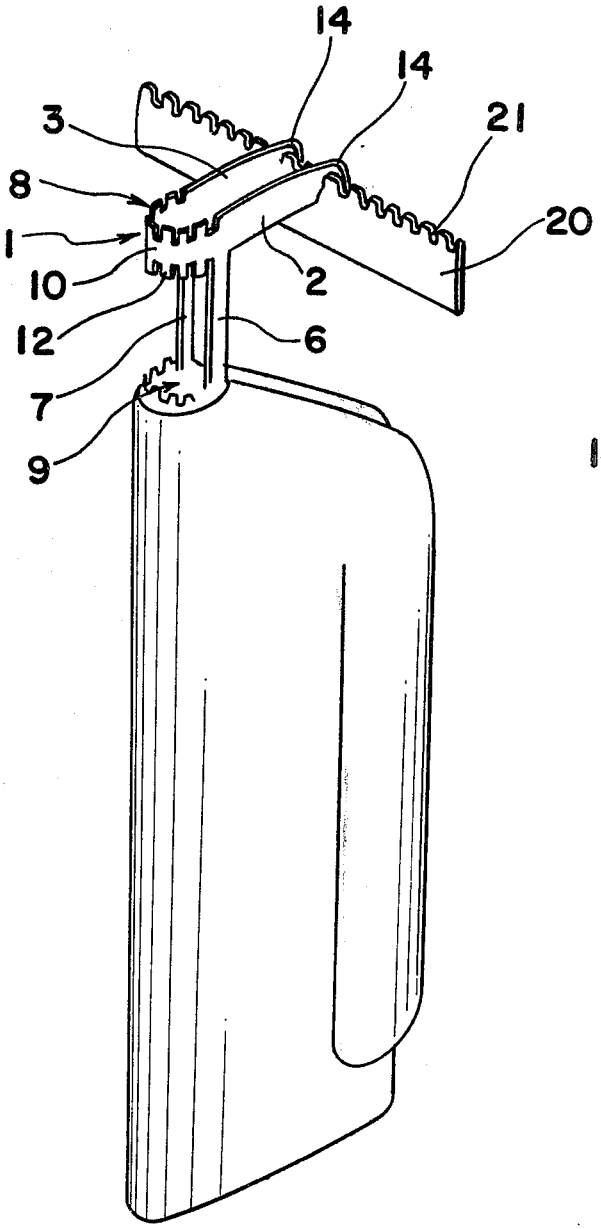
FIG. 4 is a schematic perspective view showing the foldable hanger of FIG. 1 engaged on a supporter.

In the use of the above mentioned foldable hanger, a garment to be hanged is first hanged down on the pair of shoulders 4 and 5 while the hanger is in a spread state as shown in FIG. 1. Subsequently, the hanger is folded with the hands 2 and 3 and the shoulders 4 and 5 pivoting, sharply around the centre to pile up with the other as shown in FIG. 4 until the fingers 14 of the hands 2 and 3 substantially contact with each other so as to form a hook together. The formed hook is engaged to or suspended from a hanging bar or a hanging hook of conventional type in a known manner.

Consequently, the garment is hanged down in the folded state along the vertical centre line of the back thereof within a small space approximately half the space required for the conventional hanger.

Figure 5:
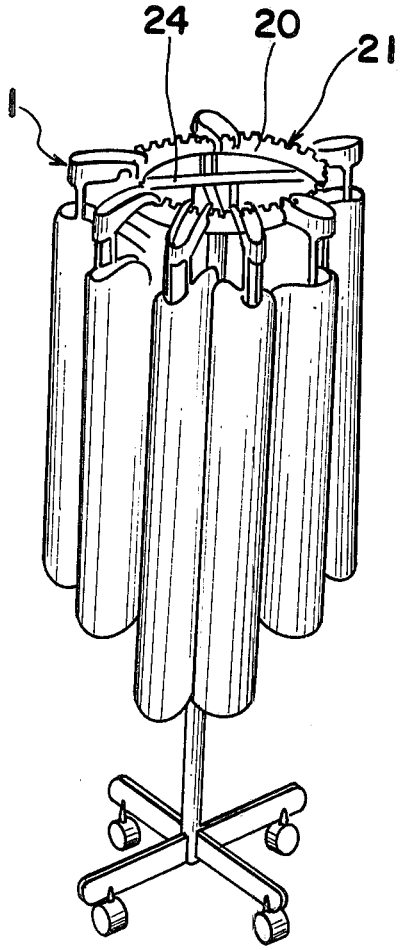
FIG. 5 is a schematic perspective view showing a display method using the hangers shown in FIG. 1.

According to the present invention, the garment hanged down by the hanger may not be inclined with respect to the vertical line thereof, since the hook in the folded state of the hanger is so designated as to position substantially on the vertical line passing through the centre of gravity of the garment being folded in conformity with the folded state of the hanger. In order to prevent the folded hook from developing toward the spread state, it is desirable to use a ruck bar 20 in combination of the foldable hangers, the ruck bar 20 having a plurality of equally spaced indents 21 formed along an upper edge thereof for engaging the fingers 14 of the hands 2 and 3 therein in a manner as shown in FIG. 4. Moreover, the ruck bar 20 may be formed of either a straight supporter such as shown in FIG. 4 or a ring supporter such as shown in FIG. 5. If the ring supporter such as shown in FIG. 5 is mounted on a caster-equipped stand, a shop display of various types of garments can conveniently be made without a relative large space required.

Figure 6:
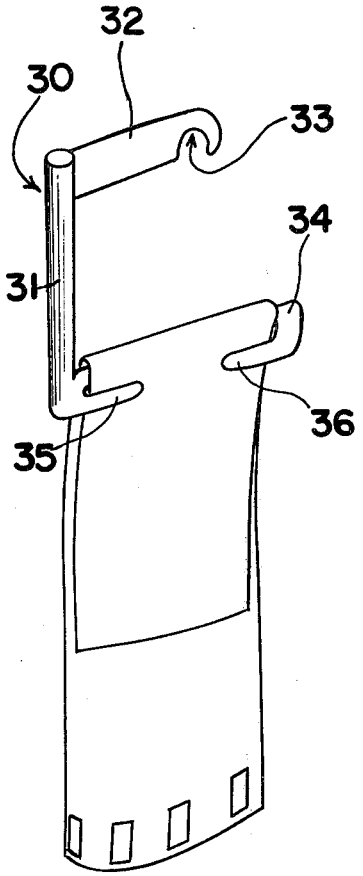
FIG. 6 is a schematic perspective view showing a hanger for hanging a trousers or slacks according to another embodiment of the present invention.

In the case of hanging a trousers or slacks together with a coat, it is desirable to use a hanger 30 specially designed as another embodiment of the present invention for hanging a trousers or slacks as shown in FIG. 6.

The hanger 30 has a vertical support rod 31, a hand 32 having a hook 33 at its free end opposite to the connected end of the hand 32 to an upper end of said rod 31, said hand extending in a direction perpendicular to said rod 31, and a hanger arm 34 extending in the same direction as said hand from the one end connected to a lower end of the said rod 31. The hanger arm 34 has its opposite ends provided a pair of hooks 35 and 36 extending in a direction opposed to each other in parallel to said hanger arm 34 for clipping an intermediate portion of the trousers or slacks to the hanger arm in a manner as shown in FIG. 6.

This hanger 30 for a trousers or slacks has an advantage that it is usable in combination with the above mentioned foldable hanger for a garment. Namely, the foldable hanger can be folded so as to surround the hanger for a trousers or slacks as shown in FIG. 7 in such a manner that the rod is positioned at a centre of the folded connecting portion and the hand and hanger arm are sandwiched between the hands and shoulders, respectively, to arrange in a line the hook with the fingers, whereby both the garment and the trousers or slacks are hanged down in a small space defined between halves of the garment on the foldable hanger in the folded state.

Figure 8:
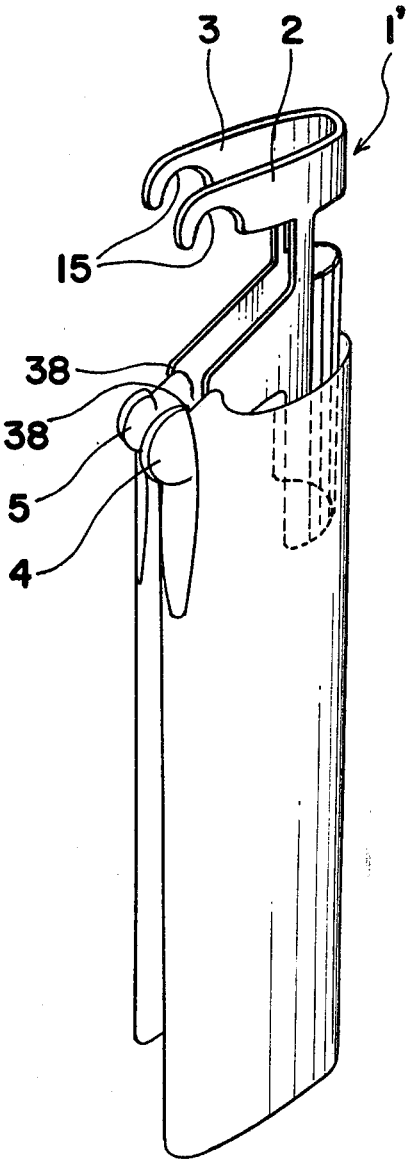
FIG. 8 is a perspective view showing a foldable hanger for lady's wears according to a further embodiment of the present invention.

It is to be noted that the foldable hanger may have recesses 38 on the upper portion of the one or each shoulder 4 or 5, as shown in FIG. 8, for enabling shoulder straps of a lady's wear, for instance, a jumper skirt to be engaged therein avoiding the possibility of slipping off the lady's wear from the foldable hanger when in the folded state.

Figure 7:
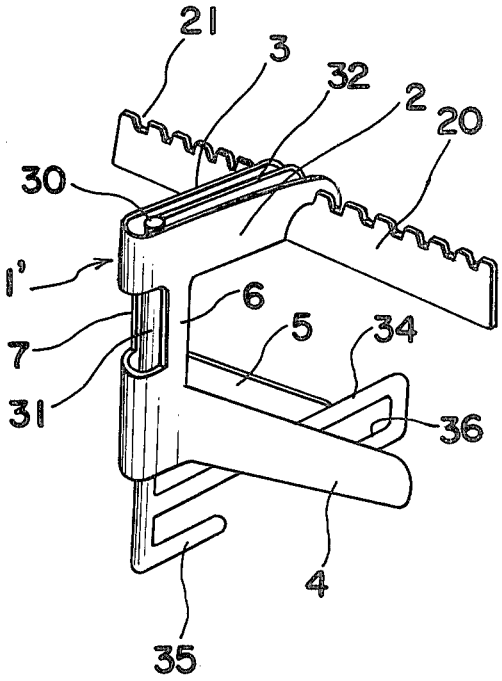
FIG. 7 is a perspective view showing the foldable hanger shown in FIG. 1 in combination with the hanger shown in FIG. 6.
Figure 9:
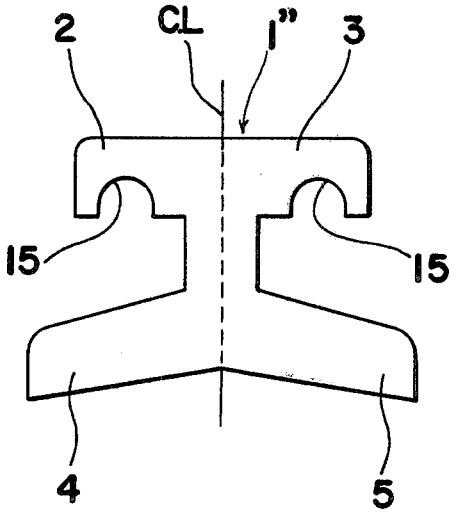
FIG. 9 is a front view showing a foldable hanger according to a still further embodiment of the present invention.

With respect to the connecting portion of the hanger, it is possible to fabricate it as a resiliently foldable or bendable thin plate 1′ or 1″ as shown in FIG. 7, 8 or 9. In this case, in order to permit easier folding of the hanger, it is desirable to make a portion along the centre line C.L of the thin plate 1″ thinner and/or softer than other portion thereof. For this purpose, it is also possible to form a V-notch along the centre line. Where the hanger is used in its spread state as shown in FIG. 1, the hands 2 and 3 should be engaged on respective hanging bars which are arranged parallel to each other and spaced a distance substantially equal to the distance between the pair of hooks of the hanger in the spread state.

Moreover, it is also possible, if desired, to pack the garment into a container such as a suitcase in the folded state together with the hanger. In this case, no fold line is formed in the colar of the garment packed into the container, since it is backed up to curve smoothly from the inside by means of the bent or folded connecting portion of the hanger.

Although the present invention has been fully described by way of example with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. A foldable hanger of one piece-construction made of synthetic resin for hanging a garment such as a coat or a suit thereon, said hanger comprising, in combination;

a substantially elongated connecting member bendable about a line substantially intermediate of the width of said connecting member;

a pair of hands extending from one end portion of the connecting member in the opposed directions with respect to each other, each of respective free ends of said hands being formed into a hook through which hanger is adapted to be engaged on an external support means, and;

a pair of shoulders extending from the other end portion of the connecting member in the opposed directions with respect to each other for the support of the garment thereon, said hands of the pair and said shoulders of the pair being, when the hanger is folded with said connecting member bent about said line substantially intermediately of the width of the connecting portion, pivotable in a direction close towards each other.

2. A foldable hanger as claimed in claim 1, wherein said connecting member comprises a pair of column means extending in parallel relation to each other, at least one flexible band bridging between said column means.

3. A foldable hanger as claimed in claim 2, wherein said band has a plurality of bones extending at right angles to said band in parallel relation to said column means and spaced an equal distance from each other.

4. A foldable hanger as claimed in claim 2, wherein there is provided two flexible bands, one bridging between respective upper portions of the column means and the other between respective lower portions of the column means.

5. A foldable hanger as claimed in claim 1, wherein each of the hands has a length approximately half the length of any one of the shoulders.

6. A combination hanger comprising, in combination; a foldable hanger of one piece-construction made of synthetic resin for hanging a garment such as a coat or a suit thereon, said hanger comprising, in combination;

a substantially elongated connecting member bendable about a line substantially intermediate of the width of said connecting member;

a pair of hands extending from one end portion of the connecting member in the opposed directions with respect to each other, each of respective free ends of said hands being formed into a hook through which hanger is adapted to be engaged on an external support means, a pair of shoulders extending from the other end portion of the connecting member in the opposed directions with respect to each other for the support of the garment thereon, said hands of the pair and said shoulders of the pair being, when the hanger is folded with said connecting member bent about said line substantially intermediately of the width of the connecting portion, pivotable in a direction close towards each other; and a hanger for a trousers or slacks comprising a vertical support rod, a hand having one end connected to an upper part of the support rod, said hand having a hook defined at its free end, and an arm connected to a lower part of the support rod and extending in parallel relation to the hand and having a pair of hooks for clipping the hanged trousers or slacks.

* * * * *